US006189603B1

(12) United States Patent
Sugimoto et al.

(10) Patent No.: US 6,189,603 B1
(45) Date of Patent: Feb. 20, 2001

(54) DOUBLE HEAT EXCHANGER HAVING CONDENSER AND RADIATOR

(75) Inventors: Tatsuo Sugimoto, Okazaki; Norihisa Sasano, Anjo; Satomi Muto, Nishikasugi-gun; Takaaki Sakane; Etuo Hasegawa, both of Nagoya, all of (JP)

(73) Assignee: Denso Corporation, Kariya (JP)

( * ) Notice: Under 35 U.S.C. 154(b), the term of this patent shall be extended for 0 days.

(21) Appl. No.: 09/399,496

(22) Filed: Sep. 20, 1999

(30) Foreign Application Priority Data

Oct. 19, 1998 (JP) ..... 10-297179
Oct. 21, 1998 (JP) ..... 10-300029

(51) Int. Cl.[7] ..... F28F 13/00
(52) U.S. Cl. ..... 165/140; 165/135
(58) Field of Search ..... 165/135, 140

(56) References Cited

U.S. PATENT DOCUMENTS 5,509,199 4/1996 Beamer et al. .

FOREIGN PATENT DOCUMENTS 198 14 028 10/1998 (DE) .
0 825 404 1/1998 (EP) .
0 838 651 4/1998 (EP) .
9-152298 6/1997 (JP) .
9-287886 11/1997 (JP) .
10-103893 4/1998 (JP) .

*Primary Examiner*—Leonard Leo
(74) *Attorney, Agent, or Firm*—Harness, Dickey & Pierce, PLC

(57) ABSTRACT

A double heat exchanger includes a radiator having a radiator tank and a radiator core portion, and a condenser having a condenser tank and a condenser core portion. The radiator tank and the condenser tank are integrally connected by a connection portion protruding from the radiator and the condenser tanks toward the radiator and condenser core portions. Therefore, the connection portion is cooled by air passing through the radiator and condenser core portions. Thus, the connection portion restricts heat from the radiator tank from being transmitted to the condenser tank through the connection portion, thereby preventing heat-exchanging capacity of the condenser from being decreased in the double heat exchanger.

19 Claims, 11 Drawing Sheets

DOUBLE HEAT EXCHANGER HAVING CONDENSER AND RADIATOR

CROSS-REFERENCE TO RELATED APPLICATION

This application is related to and claims priority from Japanese Patent Applications No. Hei. 10-297179 filed on Oct. 19, 1998, and No. Hei. 10-300029 filed on Oct. 21, 1998, the contents of which are hereby incorporated by reference.

BACKGROUND OF THE INVENTION

1. Field of the Invention

The present invention relates to a double heat exchanger having plural integrated heat-exchanging portions such as a condenser for a vehicle refrigerant cycle and a radiator for cooling engine-cooling water.

2. Description of Related Art

In a conventional double heat exchanger described in JP-A-287886, a first heat-exchanging portion and a second heat-exchanging portion are integrally formed by connecting first and second tanks for respectively supplying fluid into first and second tubes of the first and second heat-exchanging portions. However, when temperature of fluid flowing into the first heat-exchanging portion is different from temperature of fluid flowing into the second heat-exchanging portion, such as a condenser and a radiator, heat from high-temperature fluid (e.g., engine-cooling water) transfers to low-temperature fluid (e.g., refrigerant) through the integrated first and second tanks. Therefore, heat-exchanging performance of a heat-exchanging portion (e.g., condenser) in which low-temperature fluid flows is decreased.

On the other hand, in a conventional double heat exchanger described in JP-A-9-152298, a radiator and a condenser are integrated by connecting a radiator tank and a condenser tank. Further, each condenser tube is inserted into each insertion hole formed in the condenser tank, and each radiator tube is inserted into each insertion hole formed in the radiator tank. However, because each tube is inserted into each insertion hole without causing a large shake, tube-inserting performance is deteriorated, and a manufacturing method of the double heat exchanger becomes complex.

SUMMARY OF THE INVENTION

In view of the foregoing problems, it is an object of the present invention to provide a heat exchanger having first and second heat-exchanging units, which can prevent heat-exchanging performance from being decreased.

It is an another object of the present invention to provide a heat exchanger having first and second heat-exchanging units, which can be produced in low cost by reducing its manufacturing steps.

According to the present invention, a heat exchanger includes a first heat-exchanging unit, a second heat-exchanging unit disposed downstream from the first heat-exchanging unit, and a connection unit for connecting a first tank of the first heat-exchanging unit and a second tank of the second heat exchanging unit. The connection unit is disposed between the first tank and the second tank to be cooled by air flowing toward the first and second heat-exchanging units. Thus, a part of heat transmitted between the first and second tanks through the connection unit is radiated to air, and heat transmission between the first and second tanks can be effectively restricted by the connection portion. As a result, it can prevent heat-exchanging capacity of the double heat exchanger from being decreased. For example, when first fluid flowing in the first tank of the first heat-exchanging unit has temperature lower than that of second fluid flowing in the second tank of the second heat-exchanging unit, the connection unit prevents the heat-exchanging capacity of the first heat-exchanging unit from being decreased.

Preferably, the connection unit is disposed to protrude from the first and second tanks toward first and second core portions of the first and second heat-exchanging units. Therefore, the connection unit is cooled by air passing through the first and second core portions of the first and second heat-exchanging units. Thus, the connection unit can further restrict heat transmission between the first and second tanks of the first and second heat-exchanging units.

More preferably, the connection unit includes a plurality of connection portions arranged to be separated from each other in an extending direction of the first and second tanks. Therefore, the connection unit further restricts heat transmission between the first and second tanks.

Further, the first tank has plural first insertion holes into which first tubes of the first core portion are inserted to communicate with the first tank, the second tank has plural second insertion holes into which the second tubes are inserted to communicate with the second tank, the connection unit is connected to the first tank at a first portion for defining at least one of the first insertion holes and is connected to the second tank at the second portion for defining at least one of the second insertion holes, and the first portion of the first tank and the second portion of the second tank are adjacent to each other in an air flow direction. Thus, when the first tubes and the second tubes are inserted into the first and second insertion holes of the first and second tanks, the first and second tubes can be readily inserted into the first and second insertion holes respectively by using the connection unit as a guiding member for guiding the first and second tubes. As a result, manufacturing steps of the heat exchanger can be reduced, and the heat exchanger can be produced in low cost.

Preferably, the first tank has a cylindrical first tank portion for forming a first fluid passage, and the first tank portion is connected to the first tubes. The second tank has a core plate connected to the second tubes, and a second tank portion connected to the core plate to form a second fluid passage through which the second fluid flows. In the heat exchanger, the first tank portion of the first tank, the core plate of the second tank and the connection unit are integrally formed, and the first tank portion has a sectional area approximately equal to that of the core plate of the second tank portion. Thus, when the first tank portion of the first tank and the core plate of the second tank are integrally formed by extrusion or drawing, the first tank portion and the core plate can be uniformly molded, and the manufacturing performance of the first tank portion and the core plate can be improved. As a result, the heat exchanger can be readily formed in low cost.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

A first preferred embodiment of the present invention will be now described with reference to FIGS. 1–5. In the first embodiment, the present invention is typically applied to a double heat exchanger in which a condenser 100 (i.e., first heat-exchanging unit) of a vehicle air conditioner and a radiator 200 (i.e., second heat-exchanging unit) for cooling engine-cooling water from an engine are integrated.

Generally, temperature of refrigerant (i.e., first fluid) flowing through the condenser 100 is lower than temperature of engine-cooling water (i.e., second fluid) flowing through the radiator 200. Therefore, the condenser 100 is disposed on an upstream air side from the radiator 200. The condenser 100 and the radiator 200 are arranged in a straight line in an air flow direction at a most front side of an engine compartment of the vehicle.

Figure 1:
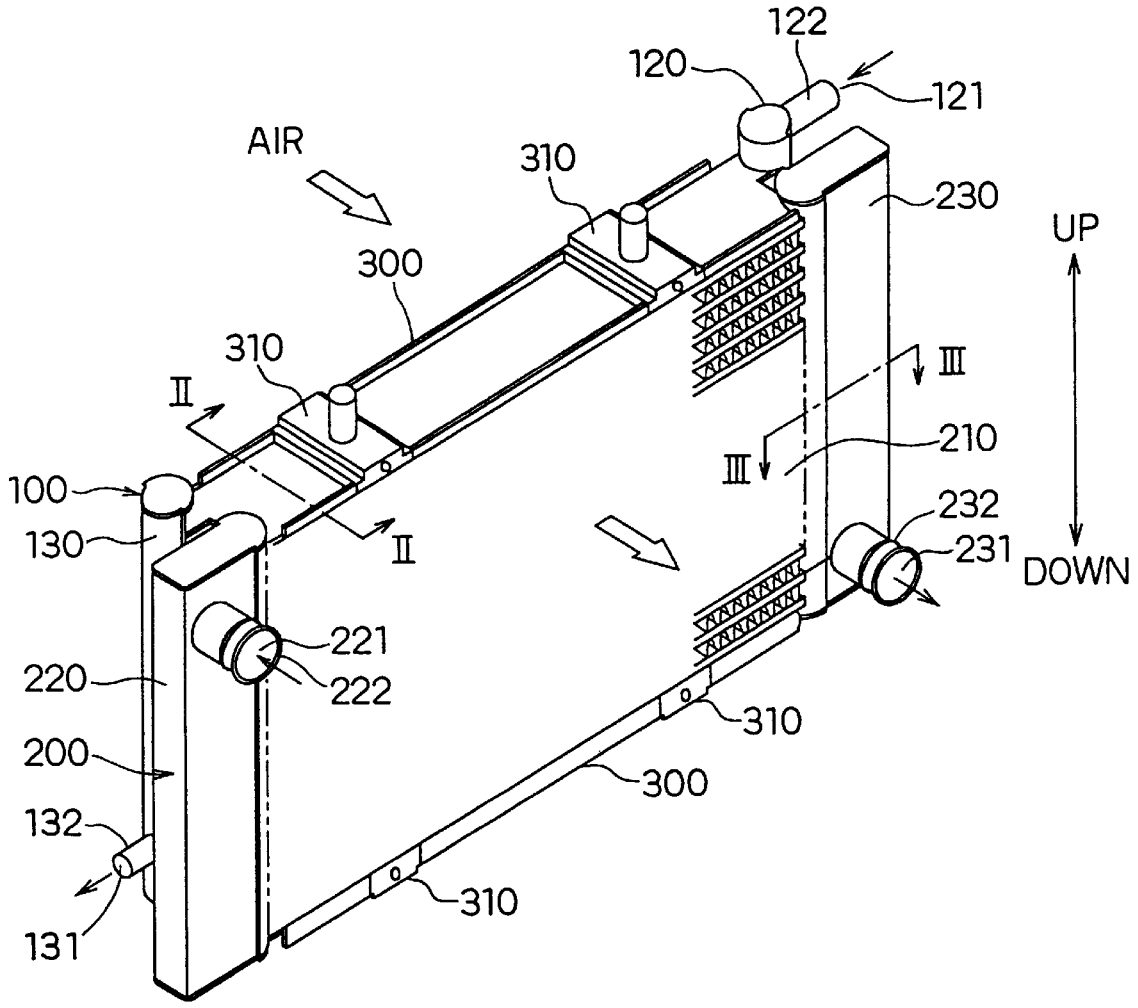
FIG. 1 is a schematic perspective view showing a double heat exchanger according to a first preferred embodiment of the present invention.
Figure 2:
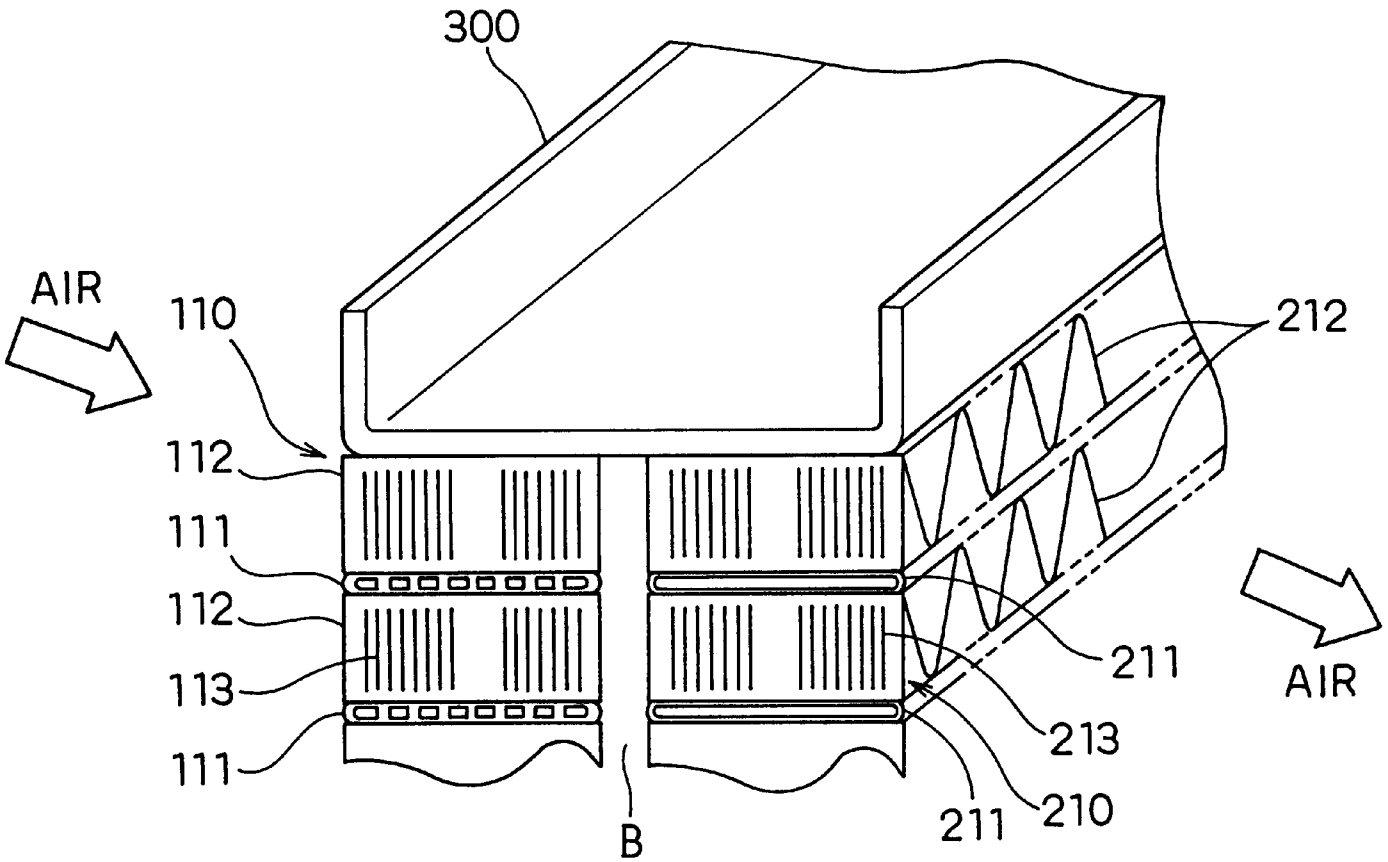
FIG. 2 is a perspective view taken along line II—II in FIG. 1, showing a part of a condenser core and a radiator core according to the first embodiment.

As shown in FIGS. 1, 2, the condenser 100 has a condenser core portion 110, and the radiator 200 has a radiator core portion 210. Both of the core portions 110, 210 are arranged linearly in the air flow direction to have a predetermined gap B therebetween so that heat conduction between the condenser core portion 110 and the radiator core portion 210 is prevented. The condenser core portion 110 has plural flat condenser tubes 111 in which refrigerant of the refrigerant cycle flows, and plural corrugated fins 112 connected to the condenser tubes 21 by brazing. The radiator core portion 210 has a structure similar to that of the condenser core portion 110, and has plural flat radiator tubes 211 and plural corrugated fins 212. The condenser and radiator tubes 111, 212 are disposed in parallel with each other, and fins 112, 212 are attached between each adjacent flat tubes 111, 212 through brazing, respectively. Further, the fins 112, 212 respectively have louvers 113, 213 for facilitating heat exchange. The louvers 113, 213 are integrally formed with the fins 112, 212, respectively, by a method such as roller forming.

As shown in FIG. 1, side plates 300 are attached to both ends of each core portion 110, 210 to enhance strength of the condenser and radiator core portions 110, 210. Each of the side plates 300 has an approximate U-shaped cross-section, and is integrally formed from a single aluminum plate. The double heat exchanger is mounted on the vehicle using brackets 310.

First and second radiator tanks 220, 230 extending in an extending direction perpendicular to a longitudinal direction of the radiator tubes 211 are connected to each longitudinal end of the radiator tubes 211 by brazing. Engine cooling water flowing from the engine into the first radiator tank 220 is distributed to each of the radiator tubes 211. After heat exchange between engine-cooling water within the radiator tubes 211 and air passing through the radiator core portion 210 is performed, engine-cooling water in the radiator tubes 211 flows into the second radiator tank 230 to be gathered therein. An inlet port 221 through which engine-cooling water from the engine is introduced is provided in an upper end side of the first radiator tank 220. On the other hand, an outlet port 231 through which engine-cooling water is discharged toward the engine is provided at a lower end side of the second radiator tank 230. Outer pipes (not shown) are connected to the first and second radiator tanks 220, 230 through joint pipes 222, 232, respectively. The joint pipes 222, 232 are connected to the first and second radiator tanks 220, 230 by brazing, respectively.

Similarly, first and second condenser tanks 120, 130 extending in an extending direction perpendicular to a longitudinal direction of the condenser tubes 111 are connected to each longitudinal end of the condenser tubes 111 by brazing, respectively. Therefore, refrigerant flowing into the first condenser tank 120 is distributed to each of the condenser tubes 111. After heat exchange between refrigerant within the condenser tubes 111 and air passing through the condenser core portion 110 is performed, refrigerant in the condenser tubes 111 flows into the second condenser tank 130 to be gathered therein. An inlet port 121 through which refrigerant from a compressor of the refrigerant cycle is introduced is provided in an upper end side of the first condenser tank 120. On the other hand, an outlet port 131 through which refrigerant is discharged toward an expansion valve (not shown) of the refrigerant cycle is provided at a lower end side of the second condenser tank 130. Outer pipes (not shown) are connected to the first and second condenser tanks 120, 130 through joint pipes 122, 132, respectively. The joint pipes 122, 132 are connected to the first and second condenser tanks 120, 130 by brazing, respectively.

Figure 3:
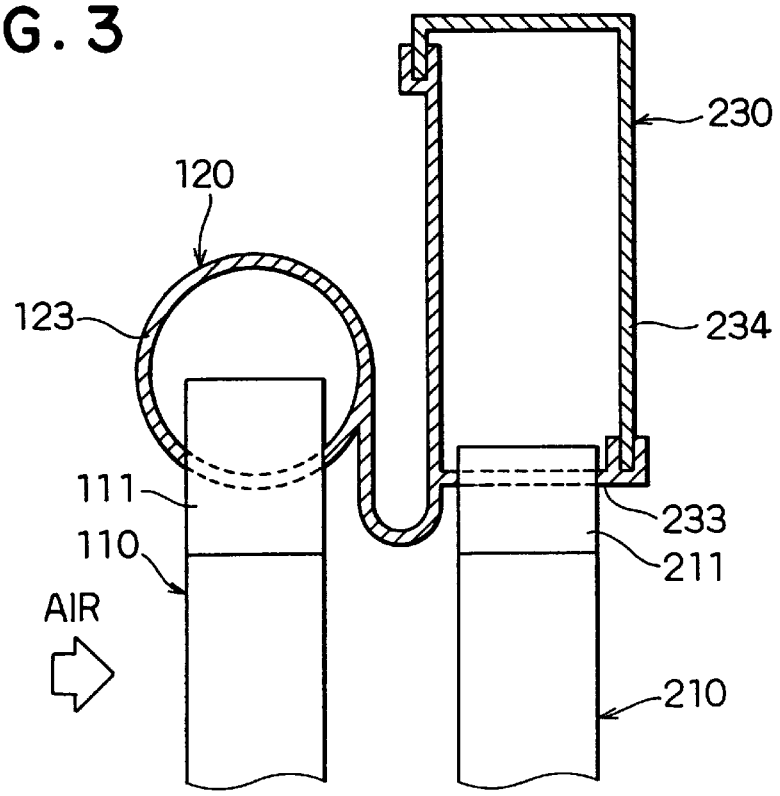
FIG. 3 is a cross-sectional view taken along line III—III in FIG. 1, showing a condenser tank and a radiator tank according to the first embodiment.

As shown in FIG. 3, the second radiator tank 230 is composed of a radiator core plate 233 connected to the radiator tube 211, and a radiator tank portion 234 connected to the radiator core plate 233. Both of the radiator core plate 233 and the radiator tank portion 234 are made of aluminum, and are integrally connected by brazing to form a space of the second radiator tank 230. On the other hand, the first condenser tank 120 is composed of a circular condenser tank portion 123 forming a space of the first condenser tank 120. Further, the condenser tank portion 123 of the first condenser tank 120 and the radiator core plate 233 of the second radiator tank 230 are connected by connection portions 400, so that the first condenser tank 120 and the second radiator tank 230 are integrated. Each connection portion 400 is formed into a U-shape to protrude from the first condenser tank 120 toward the condenser core portion 110 when viewed from an upstream air side of the condenser 100.

Figure 4:
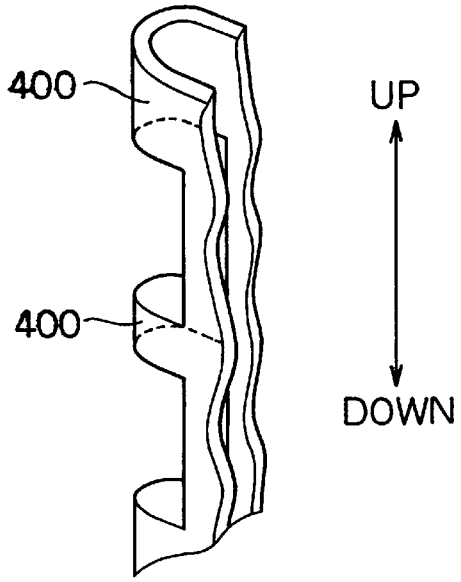
FIG. 4 is a perspective view showing a connection portion connecting the condenser tank and the radiator tank, according to the first embodiment.

Both of the condenser tank portion 123 and the radiator core plate 233 are formed integrally by extrusion or drawing using aluminum. Thereafter, a part of portion connecting the condenser tank portion 123 and the radiator core plate 233 is removed by pressing as shown in FIG. 4, so that plural connection portions 400 are separately formed in a longitudinal direction of the tanks 120, 230.

In the first embodiment, the first radiator tank 220 has the same structure as that of the second radiator tank 230, and the second condenser tank 130 has the same structure as that of the first condenser tank 120. Therefore, the connection between the first radiator tank 220 and the second condenser tank 130 is similar to that between the second radiator tank 230 and the first condenser tank 120, and the explanation thereof is omitted. Hereinafter, the second radiator tank 230 and the first condenser tank 120 are simply refereed to as "radiator tank 230" and "condenser tank 120", respectively.

Figure 5A:
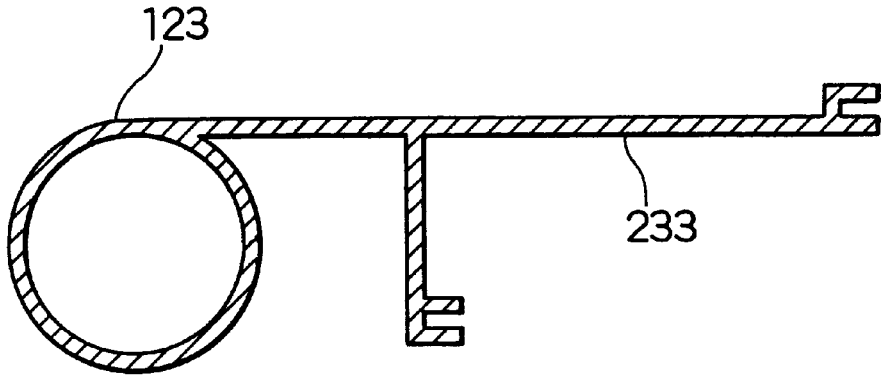
FIGS. 5A, 5B are views for explaining a manufacturing method of a condenser tank portion of the condenser tank and a core plate of the radiator tank according to the first embodiment.

Next, a manufacturing method of the condenser tank portion 123 and the radiator core plate 233 will be simply described. Firstly, the condenser tank portion 123 and the radiator core plate 233 are integrally formed by extrusion or drawing in a molding step. In the molding step, a position corresponding to the connection portion 400 is formed into a plate like without being bent, as shown in FIG. 5A.

Figure 5B:
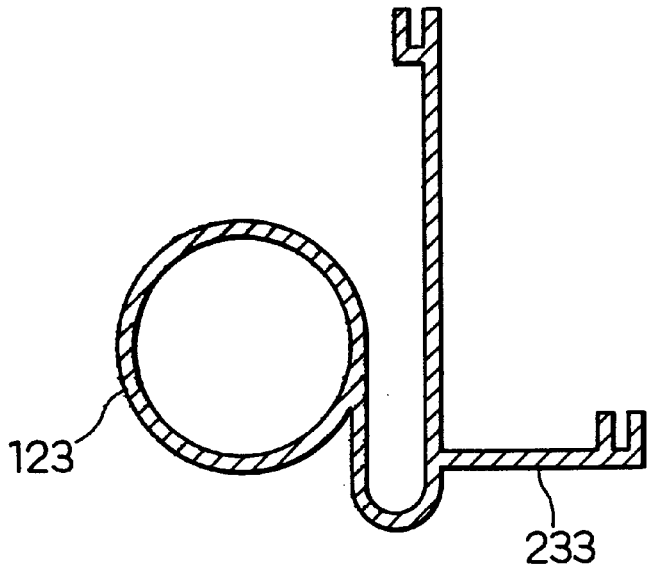

Next, insertion holes (no shown) into which the condenser tubes 111 are inserted are formed in the condenser tank portion 123 by machining such as cutting, in a machining step. Further, a part of the plate is removed by pressing at positions corresponding to the connection portions 400, and insertion holes (not shown) into which the radiator tubes 211 are inserted are formed in the radiator core plate 233 by pressing, in a first pressing step. After the first pressing step, as shown in FIG. 5B, the position corresponding to the connection portion 400 is bent to an approximate U-shape, in a second pressing step.

According to the first embodiment of the present invention, the connection portions 400 protrude from the first condenser tank 120 toward the condenser core portion 110 when viewed from an upstream air side of the double heat exchanger. That is, the connection portions 400 are bent to protrude the condenser core portion 110 and the radiator core portion 210 from the both tanks 120, 230. Therefore, the connection portions 400 can contact air passing through the condenser core portion 110 of the condenser 100 and radiator core portion 210 of the radiator 200, so that the connection portions 400 are cooled by air. Thus, a part of heat transmitting from the radiator tank 230 to the condenser tank 120 through the connection portions 400 is radiated into air. As a result, the connection portions 400 can restrict heat from being transmitted from the radiator tank 230 to the condenser tank 120, thereby preventing heat-exchanging capacity of the condenser 100 from being decreased.

In the above-described embodiment of the present invention, each connection portion 400 is formed into the U-shape by bending, after the portion corresponding to the connection portions 400 is formed into a flat shape. However, the U-shaped connection portions 400 may be directly formed by extrusion or drawing, and each of the connection portions 400 may be formed into an approximate V-shape. Further, the second pressing step may be performed before the first pressing step.

Figure 6:
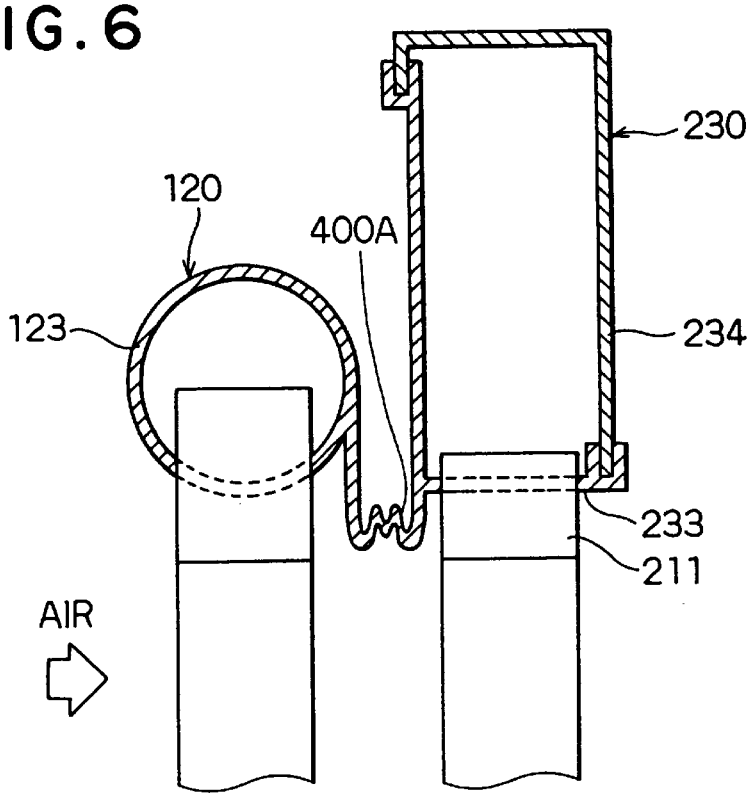
FIG. 6 is a cross-sectional view showing a condenser tank and a radiator tank of a double heat exchanger according to a second preferred embodiment of the present invention.

A second preferred embodiment of the present invention will be now described with reference to FIG. 6. In the above-described first embodiment of the present invention, each connection portion 400 has a single bent portion to be simply formed into the U-shape. However, in the second embodiment, a connection potion 400A connecting the first condenser tank 120 and the second radiator tank 230 is plurally bent to be formed into a wave shape, as shown in FIG. 6. Therefore, heat-transmitting distance of the connection portion 400A through which heat is transmitted from the radiator tank 230 to the condenser tank 120 becomes longer. Thus, the connection portion 400A can further effectively restrict heat-transmission from the radiator tank 230 to the condenser tank 120. The other portions in the second embodiment are similar to those in the first embodiment of the present invention, and the explanation thereof is omitted.

Figure 7:
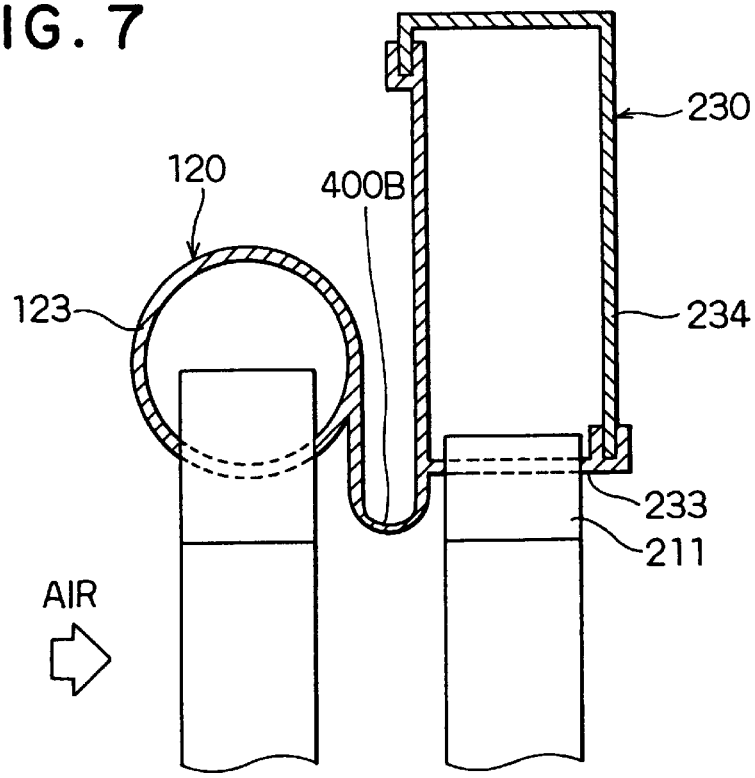
FIG. 7 is a cross-sectional view showing a condenser tank and a radiator tank of a double heat exchanger according to a third preferred embodiment of the present invention.

A third preferred embodiment of the present invention will be now described with reference to FIG. 7. In the above-described first and second embodiments, the connection portion 400, 400A has the same thickness as that of the condenser tank portion 123 and the radiator core plate 233. However, in the third embodiment, a connection portion 400B is formed to be thinner than a member forming both of the condenser and radiator tanks 120, 230, such as the condenser tank portion 123, the radiator core plate 233 and the radiator tank portion 234. Therefore, a sectional area of the connection portion 400B becomes smaller, and it can effectively prevent heat from being transmitted from the radiator tank 230 to the condenser tank 120 through the connection member 400B.

In the above-described embodiments, plural the connection portions 400, 400A, 400B are separately formed in the longitudinal direction of the condenser and radiator tanks 110, 210. However, the connection portion 400, 400A, 400B may be formed over an entire area of the tanks 110, 210.

Further, in the above-described first to third embodiments, the connection portions 400, 400A, 400B protrude toward the condenser core portion 110 and the radiator core portion 210 from the condenser tank 120 and the radiator tank 230. However, the connection portions 400, 400A, 400B may be placed at the other position where air flows. For example, the connection portions 400, 400A, 400B may protrude toward a side opposite the condenser core portion 110 and the radiator core portion 210 from the condenser tank 120 and the radiator tank 230, so that the connection portions 400, 400A, 400B are cooled by blown-air. Further, a connection portion having a wave shape may be formed to be thinner than other members forming the condenser and radiator tanks 120, 230.

Figure 8:
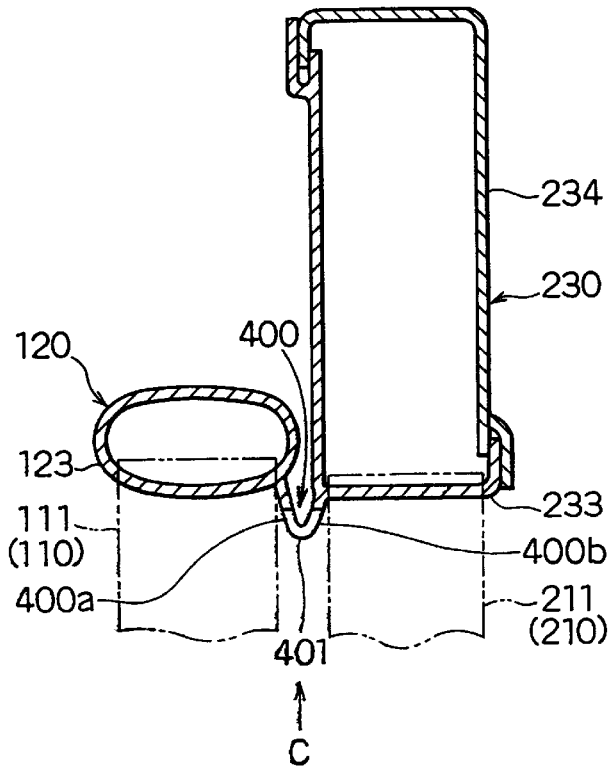
FIG. 8 is a cross-sectional view showing a condenser tank and a radiator tank of a double heat exchanger according to a fourth preferred embodiment of the present invention.
Figure 9:
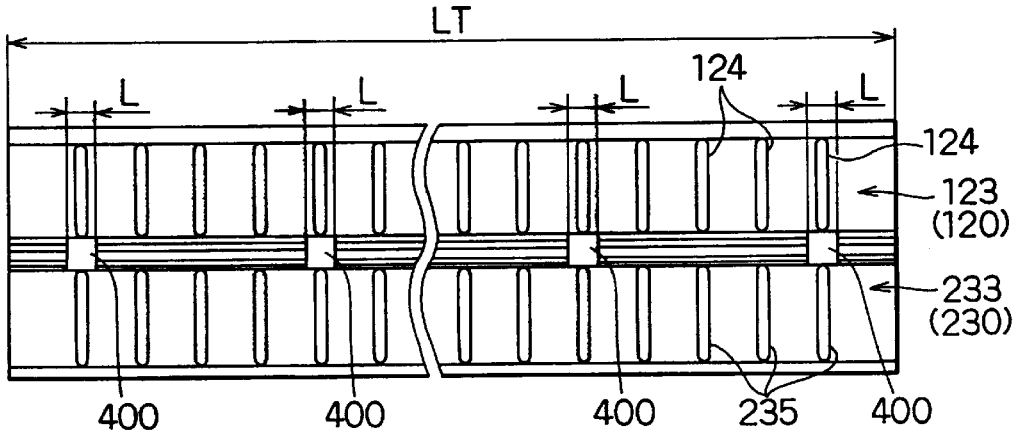
FIG. 9 is a side view taken along arrow C in FIG. 8.

A fourth preferred embodiment of the present invention will be now described. In the fourth embodiment, the portions similar to those in the above-described first embodiment of the present invention are indicated with the same reference numbers, and the explanation thereof is omitted. In the fourth embodiment, the condenser tank 120 has the condenser tank portion 123 connected to the condenser tubes 111, and the condenser tank portion 123 is formed into an approximate elliptical shape in cross section as shown in FIG. 8. As shown in FIG. 9, flat-like first insertion holes 124 into which the condenser tubes 111 are inserted are formed in the condenser tank portion 123 of the first condenser tank 120, and flat-like second insertion holes 235 into which the radiator tubes 211 are inserted are formed in the radiator core plate 233 of the second radiator tank 230.

Similarly to the above-described first embodiment, both tanks 120, 230 are connected by the connection portions 400 provided between both tanks 120, 230, so that both tanks 120, 230 are integrally formed. Further, in the fourth embodiment, the connection portions 400 are formed between the first and second insertion holes 124, 235 in a main radial direction of the first and second insertion holes 124, 235.

Similarly to the above-described first embodiment, in the fourth embodiment of the present invention, each connection portion 400 is formed into a U-shape or a V-shape to protrude toward the condenser core portion 110 and the radiator core portion 210. Each connection portion 400 includes a top end portion (bent portion) 401 protruding toward both core portions 110, 210, a first side surface on a side of the condenser tubes 111, and a second side surface on a side of the radiator tubes 211. In the fourth embodiment, plural connection portions 400 are separately formed in the longitudinal direction of the condenser tank 120 and the radiator tank 230. For example, the condenser tank portion 123, the radiator core plate 233 and a portion corresponding to the connection portions 400 are integrally formed by extrusion or drawing, and thereafter, a part of the top end portion 401 of the connection portions 400 is removed by pressing. Therefore, in the longitudinal direction of the condenser tank 120 and the radiator tank 230, plural recess portions are formed between adjacent connection portions 400.

As shown in FIG. 9, each of the connection portions 400 has a dimension L in the longitudinal direction of the condenser tank 120 and the radiator tank 230. In the fourth embodiment of the present invention, the recess portions and the connection portions 400 are provided in such a manner that a ratio of a total of each dimension L of the connection portions 400 to a longitudinal dimension LT of both tanks 120, 230 is set to be equal to or lower than 0.5 (i.e., $\Sigma L/LT \geqq 0.5$). The radiator tank portion 234 is formed by pressing using a plate where a brazing material and a sacrifice corrosion material is coated.

Figure 10A:
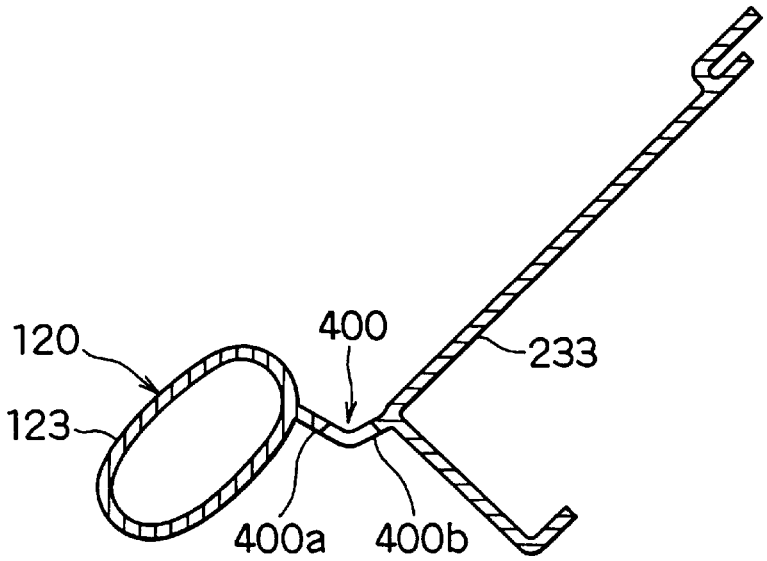
FIGS. 10A, 10B are views for explaining a manufacturing method of a condenser tank portion of a condenser tank and a core plate of a radiator tank according to the fourth embodiment.
Figure 10B:
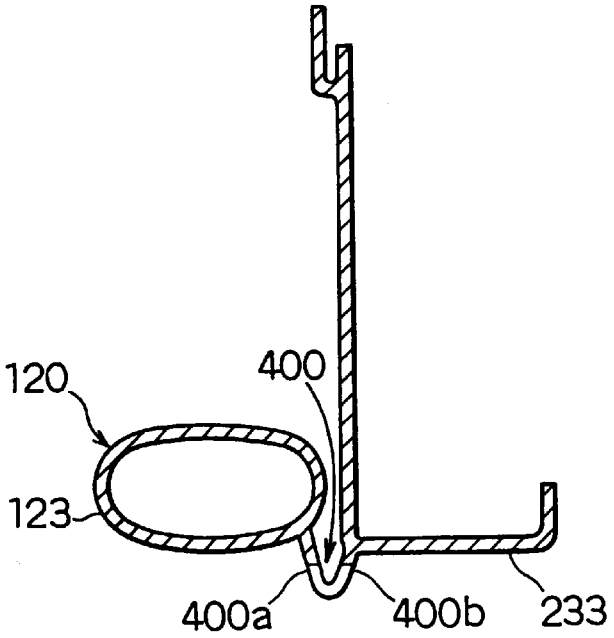

Next, a manufacturing method of the condenser tank portion 123 and the radiator core plate 233 according to the fourth embodiment will be simply described. Firstly, the condenser tank portion 123 and the radiator core plate 233 are integrally formed by extrusion or drawing as shown in FIG. 10A. At this step, a portion corresponding to the connection portion 400 is bent to an approximate right angle (90°) without being bent to an acute angle such as the U-shape or V-shape. Thereafter, the first insertion holes 124 are formed in the condenser tank portion 123 by machining in a machining step. Further, a part of portion corresponding to the connection portions 400 is removed by pressing to form the recess portions, and the second insertion holes 235 are formed by pressing in the radiator core plate 233 in a first pressing step. Thereafter, as shown in FIG. 10B, the connection portion 400 is bent to a U-shape or a V-shape by pressing in a second pressing step.

Figure 11A:
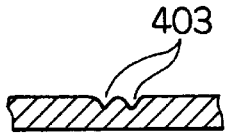
FIGS. 11A, 11B are sectional views showing recesses formed in members corresponding to a top end portion of a connection portion.
Figure 11B:
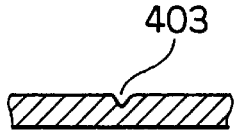
Figure 11C:
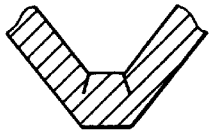
FIGS. 11C, 11D are sectional views showing the top end portion of the connection portion, according to the fourth embodiment.
Figure 11D:
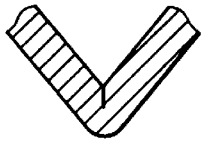

During the second pressing step, a part of portion of the connection portion 400, at a position corresponding to the top end portion 401, is recessed so that a recess portion 403 is formed as shown in FIGS. 11A, 11B. By providing the recess portion 403, the top end position 401 of the connection portion 400 can be readily bent as shown in FIGS. 11C, 11D.

According to the fourth embodiment of the present invention, each connection portion 400 connects the larger-diameter end portion defining the first insertion holes 124 in the main-radial direction and the larger-diameter end portion defining the second insertion holes 235 in the main-radial direction, so that both tanks 120, 230 are integrated, and connection portions 400 protrude toward the condenser and radiator core portions 110, 210. Therefore, when the condenser tubes 111 and the radiator tubes 211 are inserted into the first and second insertion holes 124, 235, respectively, the first side surface 400*a* on the side of the condenser tubes 111 and the second side surface 400*b* on the side of the radiator tubes 211 are used as guiding surfaces. Thus, the condenser tubes 111 and the radiator tubes 211 can be readily inserted into the first and second insertion holes 124, 235, respectively, to be assembled therein through the first and second side surfaces 400*a*, 400*b* of the connection portions 400. As a result, manufacturing steps of the double heat exchanger can be reduced, and the double heat exchanger can be produced in low cost.

Further, the connection portions 400 are positioned to protrude from the first condenser tank 120 toward the condenser core portion 110 when viewed from the upstream air side of the double heat exchanger, similarly to the above-described first embodiment. Therefore, the connection portions 400 contact air flowing through the condenser core portion 110 of the condenser 100 and the radiator core portion 210 of the radiator 200 to be cooled by air. Thus, the connection portions 400 restrict heat from being transmitted from the radiator 230 to the condenser 120 through the connection portions 400.

Further, in the fourth embodiment, because the sectional area of the condenser tank portion 123 is set to be approximately equal to the sectional area of the radiator core plate 233, the condenser tank portion 123 and the radiator core plate 233 can be uniformly integrally formed by the extrusion or drawing. Therefore, manufacturing performance of the condenser tank portion 123 and the radiator core plate 233 can be improved.

The radiator core plate 233 is formed by the extrusion or drawing. Therefore, a brazing material or a sacrifice corrosion material is need to be applied on the radiator core plate 233 after the extrusion or drawing, for applying the brazing material or the sacrifice corrosion material on the radiator core plate 233. Therefore, manufacturing steps of the radiator tank 230 are increased. However, according to the fourth embodiment of the present invention, the radiator tank 230 is composed of the radiator core plate 233 and the radiator tank portion 234, and the radiator tank portion 234 is formed from a plate where the brazing material and the sacrifice corrosion material are coated. Therefore, it is not necessary to apply the brazing material or the sacrifice corrosion material on the radiator core plate 233, thereby preventing the manufacturing steps of the radiator tank 230 from being increased.

Figure 12:
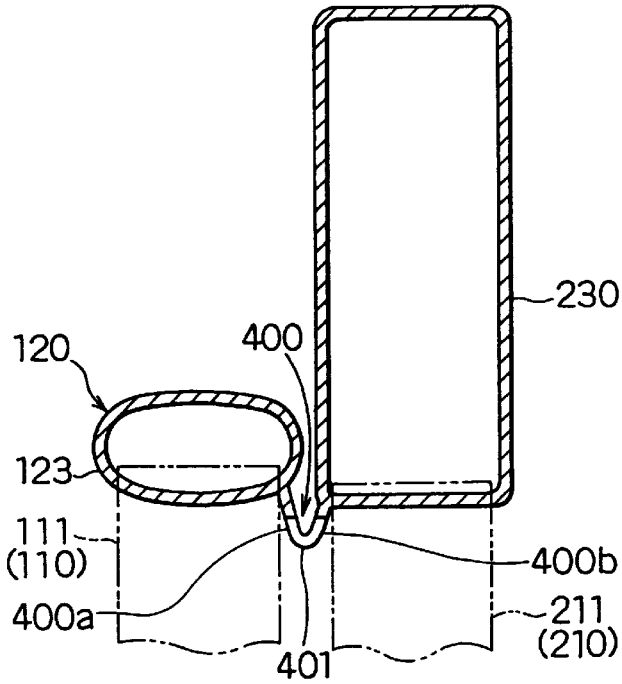
FIG. 12 is a cross-sectional view showing a condenser tank and a radiator tank of a double heat exchanger according to a modification of the fourth embodiment.
Figure 13:
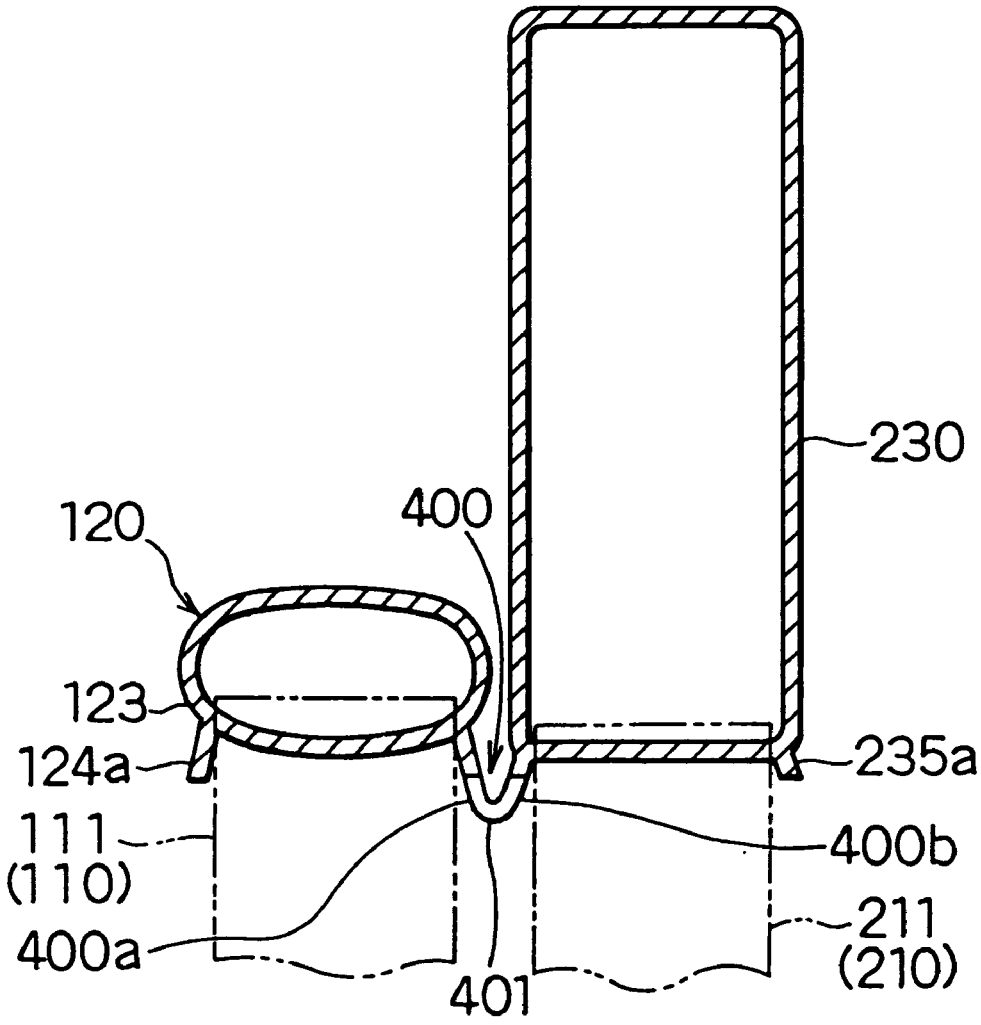
FIG. 13 is a cross-sectional view showing a condenser tank and a radiator tank of a double heat exchanger according to an another modification of the fourth embodiment.

In the above-described fourth embodiment, the radiator tank 230 is formed by brazing the radiator core plate 233 and the radiator tank portion 234. However, similarly to the condenser tank 120, the radiator tank 230 may be integrally formed by extrusion or drawing, as shown in FIG. 12. Further, as shown in FIG. 13, a guiding wall 124*a* may provided in the condenser tank 120 on a side opposite to the connection portion 400, to guide the condenser tubes 111 when the condenser tubes 111 are inserted into the first insertion holes 124. Further, a guiding wall 235*a* may provided in the radiator tank 230 on a side opposite to the connection portion 400, to guide the radiator tubes 211 when the radiator tubes 211 are inserted into the second insertion holes 235. In this case, it is necessary to provide the guide walls 124*a*, 235*a* on the longer-diameter end portions defining the first and second insertion holes 124, 235.

Figure 14:
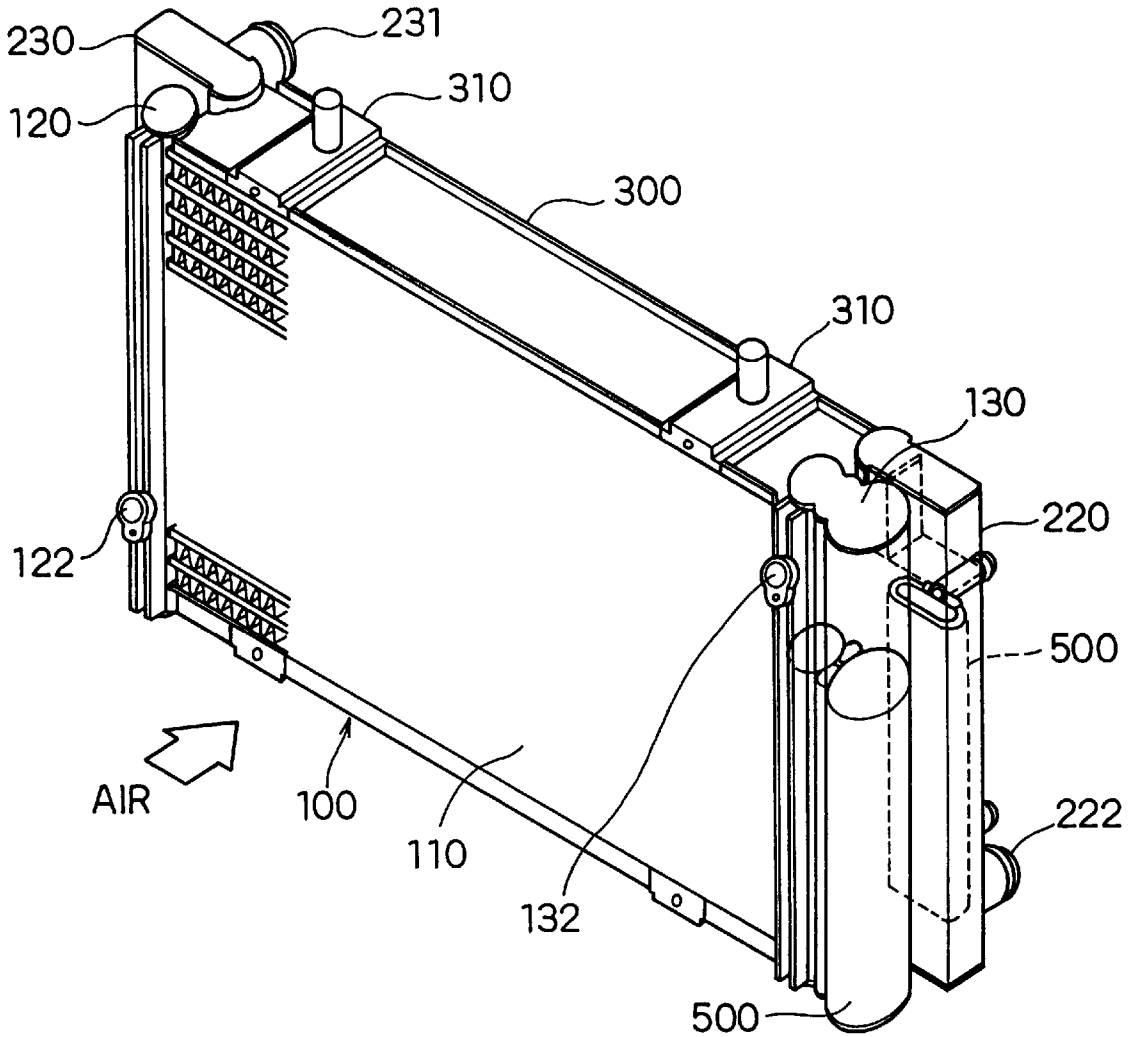
FIG. 14 is a schematic perspective view showing a double heat exchanger according to a modification of the present invention.

Further, in each of the above-described embodiments, as shown in FIG. 14, a receiver 500 of the refrigerant cycle may be integrated to the second condenser tank 130. Further, as shown in FIG. 14, an oil cooler 600 for cooling an oil such as an engine oil may be accommodated in the radiator tank 220.

Figure 15:
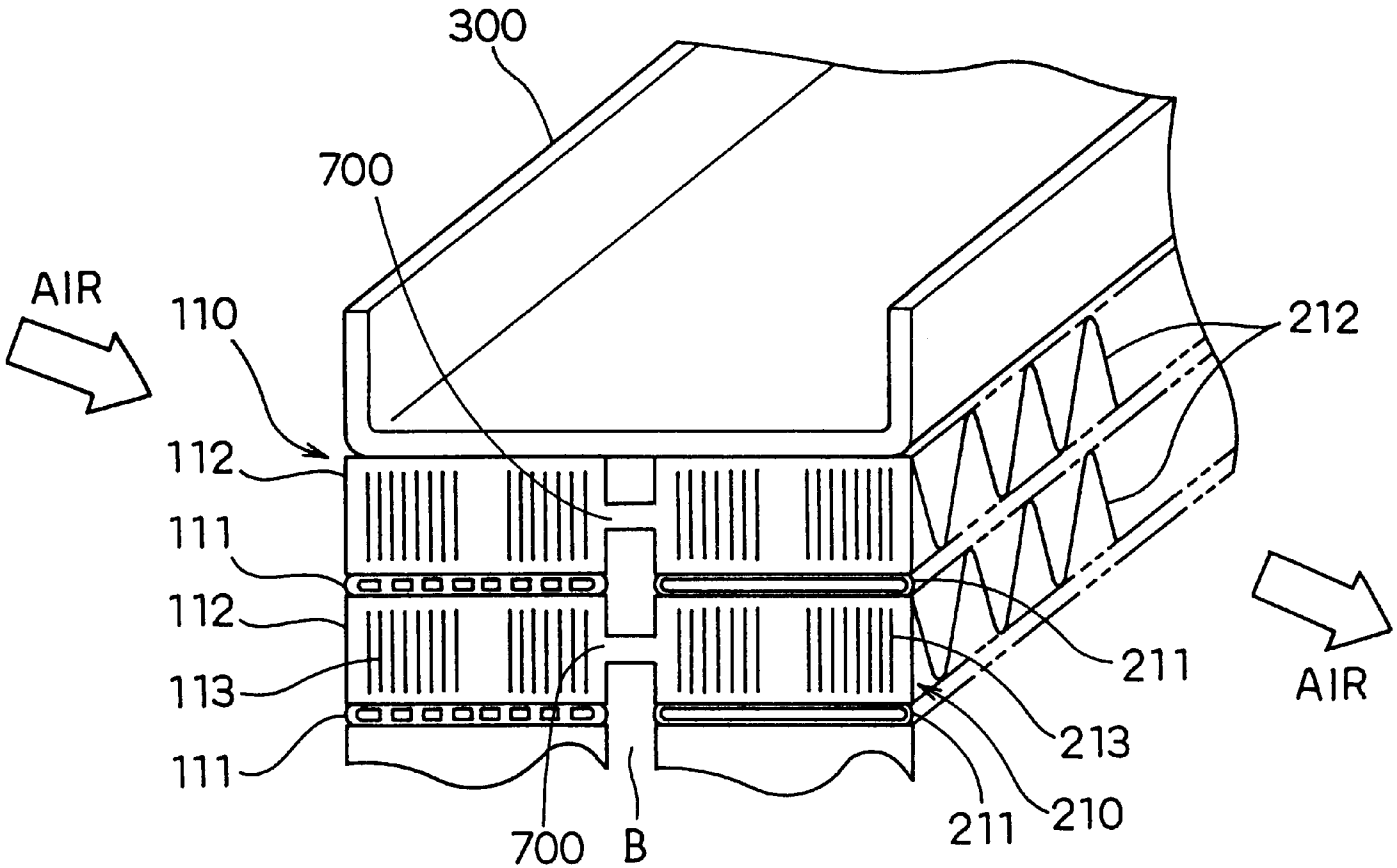
FIG. 15 is a perspective view showing a part of a condenser core and a radiator core according to an another modification of the present invention.

Further, in each of the above-described embodiments, the condenser fins 112 and the radiator fins 212 are separately formed. However, as shown in FIG. 15, a link portion 700 connecting the condenser fins 112 and the radiator fins 212 may be provided as shown in FIG. 15. In this case, the top end portions 401 of the connection portions 400 may contact the link portion 700. Therefore, heat transmitted to the connection portions 400 can be transmitted to the radiator fins 212 and the condenser fins 112, and heat-exchanging capacity of the condenser 100 can be further improved in the double heat exchanger.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a first heat-exchanging unit including:

a first core portion for performing heat exchange between a first fluid and air, said first core portion having a plurality of first tubes in which said first fluid flows, and a first tank extending in an extending direction perpendicular to a longitudinal direction of said first tubes and being connected to one end of each first tube in the longitudinal direction to communicate with said first tubes;

a second heat-exchanging unit disposed on a downstream air side of said first heat-exchanging unit, said second heat-exchanging unit including:

a second core portion for performing heat exchange between a second fluid and air, said second core portion having a plurality of second tubes in which said second fluid flows, and a second tank extending in a direction parallel to the extending direction of said first tank and being connected to one end of each second tube in the longitudinal direction to communicate with said second tubes, said second tank being separated from said first tank to have a predetermined distance therebetween; and a connection unit for connecting said first tank and said second tank, said connection unit being disposed between said first tank and said second tank to be cooled by air flowing toward said first and second heat-exchanging units, said connection unit being disposed to protrude from and beyond said first and second tanks toward said first and second core portions.

2. The heat exchanger according to claim 1, wherein said first fluid has temperature lower than that of said second fluid.

3. The heat exchanger according to claim 1, wherein said connection unit has a protrusion between said first and second core portions in an air flowing direction.

4. The heat exchanger according to claim 3, wherein said protrusion has an approximate U-shaped section.

5. The heat exchanger according to claim 3, wherein said protrusion has an approximate V-shaped section.

6. The heat exchanger according to claim 1, wherein said connection unit includes a plurality of connection portions arranged to be separated from each other in the extending direction of said first and second tanks.

7. The heat exchanger according to claim 1, wherein said connection unit has a thickness thinner than that of said first tank and said second tank.

8. The heat exchanger according to claim 1, wherein said connection unit has plural bent portions bent to a wave shape.

9. The heat exchanger according to claim 1, wherein:

said first tank has plural first insertion holes into which said first tubes are inserted;

said second tank has plural second insertion holes into which said second tubes are inserted;

said connection unit is connected to said first tank at a first portion for defining at least one of said first insertion holes and is connected to said second tank at a second portion for defining at least one of said second insertion holes; and said first portion of said first tank and said second portion of said second tank are adjacent to each other in an air flow direction.

10. The heat exchanger according to claim 9, wherein:

each of said first and second tubes is formed into a flat like;

each of said first and second insertion holes is formed into a flat like to have a longest diameter in a main radial direction; and said first and second portions connected to said connection unit is positioned in said first and second tanks in said main radial direction.

11. The heat exchanger according to claim 1, wherein said connection unit is integrally formed with said first and second tanks.

12. The heat exchanger according to claim 1, wherein:

said first tank has a cylindrical first tank portion for forming a first fluid passage through which said first fluid flows, said first tank portion being connected to said first tubes;

said second tank has a core plate connected to said second tubes, and a second tank portion connected to said core plate to form a second fluid passage through which said second fluid flows; and said first tank portion, said core plate and said connection unit are integrally formed.

13. The heat exchanger according to claim 12, wherein said first tank portion has a sectional area approximately equal to that of said core plate.

14. A heat exchanger comprising:

a first core portion for performing heat exchange between a first fluid and air, said first core portion having a plurality of first tubes in which said first fluid flows;

a first tank extending in an extending direction perpendicular to a longitudinal direction of said first tubes, and having plural first insertion holes into which said first tubes are inserted to communicate with said first tank;

a second core portion for performing heat exchange between a second fluid and air, said second core portion being disposed at a downstream air side of said first core portion and having a plurality of second tubes in which said second fluid flows;

a second tank extending in a direction parallel to the extending direction of said first tank and having plural second insertion holes into which said second tubes are inserted to communicate with said second tanks, said second tank being separated from said first tank to have a predetermined distance therebetween; and a connection unit for connecting said first tank and said second tank, said connection unit is bent to protrude from said first and second tanks toward said first and second core portions, wherein:

said connection unit is connected to said first tank at a first portion for defining at least one of said first insertion holes and is connected to said second tank at a second portion for defining at least one of said second insertion holes; and said first portion of said first tank and said second portion of said second tank are adjacent to each other in an air flow direction.

15. The heat exchanger according to claim 14, wherein:

each of said first and second tubes is formed into a flat like;

each of said first and second insertion holes is formed into a flat like to have a longest diameter in a main radial direction; and said first and second portions connected to said connection unit is positioned in said first and second tanks in said main radial direction.

16. The heat exchanger according to claim 14, wherein said connection unit has a protrusion between said first and second core portions in an air flowing direction.

17. The heat exchanger according to claim 14, wherein said connection unit includes a plurality of connection portions arranged to be separated from each other in the extending direction of said first and second tanks.

18. The heat exchanger according to claim 14, wherein:

said first tank has a cylindrical first tank portion for forming a first fluid passage through which said first fluid flows, said first tank portion being connected to said first tubes;

said second tank has a core plate connected to said second tubes, and a second tank portion connected to said core plate to form a second fluid passage through which said second fluid flows;

said first tank portion, said core plate and said connection unit are integrally formed; and said first tank portion has a sectional area approximately equal to that of said core portion.

19. The heat exchanger according to claim 14, wherein:

said connection unit has a first connection surface for guiding said first tubes when said first tubes are inserted into said first insertion holes, and a second connection surface for guiding said second tubes when said second tubes are inserted into said second insertion holes.

* * * * *